US008197251B2

(12) United States Patent
Ten Hoeve

(10) Patent No.: US 8,197,251 B2
(45) Date of Patent: Jun. 12, 2012

(54) PREMIX BURNER

(75) Inventor: Dirk Ten Hoeve, Ruinerwold (NL)

(73) Assignee: Bekaert Combustion Technology B.V., Assen (NL)

( * ) Notice: Subject to any disclaimer, the term of this patent is extended or adjusted under 35 U.S.C. 154(b) by 0 days.

(21) Appl. No.: 12/747,118

(22) PCT Filed: Dec. 15, 2008

(86) PCT No.: PCT/EP2008/067558

§ 371 (c)(1),
(2), (4) Date: Jun. 9, 2010

(87) PCT Pub. No.: WO2009/077505

PCT Pub. Date: Jun. 25, 2009

(65) Prior Publication Data

US 2010/0273120 A1 Oct. 28, 2010

Related U.S. Application Data

(60) Provisional application No. 61/043,624, filed on Apr. 9, 2008.

(30) Foreign Application Priority Data

Dec. 17, 2007 (EP) ..... 07150052

(51) Int. Cl.
*F23D 14/14* (2006.01)

(52) U.S. Cl. ..... 431/328; 431/326; 431/354

(58) Field of Classification Search ..... 431/328, 431/326, 354, 329
See application file for complete search history.

(56) References Cited

U.S. PATENT DOCUMENTS

| | | | | |
|---|---|---|---|---|
| 5,474,443 | A | 12/1995 | Viessmann et al. | |
| 5,931,660 | A * | 8/1999 | Amrhein et al. | 431/328 |
| 6,162,049 | A * | 12/2000 | Pellizzari et al. | 431/326 |
| 2004/0121274 | A1 * | 6/2004 | Boyes | 431/7 |

FOREIGN PATENT DOCUMENTS

| | | | |
|---|---|---|---|
| CN | 2158977 | Y | 3/1994 |
| CN | 2420524 | Y | 2/2001 |
| DE | 195 21 811 | A1 | 1/1996 |
| DE | 295 20 309 | U1 | 6/1996 |
| EP | 0 594 262 | A1 | 4/1994 |
| EP | 0 795 721 | A | 9/1997 |
| WO | WO 2004/092647 | A1 | 10/2004 |

* cited by examiner

*Primary Examiner* — Alfred Basichas
(74) *Attorney, Agent, or Firm* — Foley & Lardner LLP

(57) ABSTRACT

The present invention provides a gas burner, preferably a premix burner, comprising a support having a central gas inlet port for supply of gas into a gas supply chamber. The gas supply chamber is enclosed by a first metal burner membrane at its side and an end cap opposite to said gas inlet port. The end cap is connected to the top of the first burner membrane. The burner membrane is connected at the bottom to the support through its base section. The end cap is formed by a second burner membrane. The exterior surface of the first burner membrane and the end cap is made of perforated heat-resistant sheet metal plate.

20 Claims, 3 Drawing Sheets

PREMIX BURNER

TECHNICAL FIELD

Figure 1A:
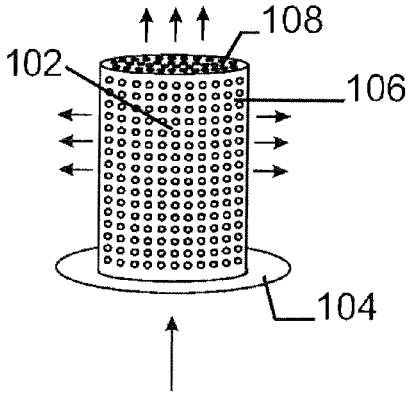

The present invention provides improved gas burners with optimal combustion in the limited space of modern heat exchangers. More specifically, the invention relates to premix gas burners comprising a further active burner surface at the end cap of the burner.

BACKGROUND ART

Modern heat exchangers are evolving in design and becoming more compact. Since the available space in the combustion chamber of modern heat exchangers is limited, improved gas burners providing optimal burning surfaces are needed.

Conventional burners do not allow for an optimal combustion in modern heat exchangers because the available space in the heat exchanger is not used optimally by the produced flames. This is inherent to the active burner surface of the gas burner, which is not adapted to the design of the heat exchanger.

The atmospheric burner described in EP 0594262 has a wall of gauze arranged around the gas/air mixing chamber. However, in order to stabilize the flame, a guiding wall is mounted at a very short distance (1 mm) from the gauze. The burner here, for example, has a cupola burner design, comprising a gas/air mixing chamber arranged above a circular or straight row of fuel injection nozzles, bounded on one side by a continuous guiding wall element and on the other side by a wall of heat-resistant gauze.

U.S. Pat. No. 5,474,443 describes a radiant burner for boilers. The burner has a hemispherical shape with a curved burner surface of wire cloth and a gas distributor of perforated sheet metal arranged under the burner surface. The dimensions of such a burner however are delimited by the radius of the hemisphere. Modern heat exchangers however require more flexibility in dimensions, so that the available space in the combustion chamber is used optimally by the produced flames.

Another type of burner is described in WO 04/092647 by applicant. Said burner comprises a burner membrane that flows uninterruptedly over from the base section through a transition section into a closing section. Certain shapes of burners are difficult to produce uninterruptedly, especially when made of stainless steel plates or sheet metal.

It would be desirable to have a burner which avoids the aforementioned disadvantages.

DISCLOSURE OF INVENTION

It is a general object of the invention to provide a gas burner that makes optimal use of the space available in a heat exchanger.

It is a further object of the invention to provide a gas burner with an optimal combustion.

It is still a further object of the invention to provide a gas burner that makes more effective use of material.

It is yet another object of the invention to provide a gas burner with an improved effect on noise.

Another object of the invention is to provide a burner that is more compact and at the same time has a higher performance than a conventional gas burner.

It is also an object of the invention to provide a gas burner with an improved flame distribution.

The present invention provides a gas burner, preferably a premix burner, comprising a support having a central gas inlet port for supply of gas into a gas supply chamber. The gas supply chamber is enclosed by a first burner membrane at its side and an end cap opposite to said gas inlet port. The end cap is connected to the top of the first burner membrane through a connection region or seam. The burner membrane is connected at the bottom to the support through its base section. The end cap is formed by a second burner membrane. The exterior surface of the first and second burner membrane is a perforated heat-resistant sheet metal plate.

The terms "end cap" and "second burner membrane" or "second burner surface" are to be understood, in the light of this invention, as having the same meaning, in the sense that the end cap is an active end cap, also forming a burner membrane, e.g. with slots and/or holes for combustion to take place.

The major advantage of the gas burner of the present invention is the more effective use of material since the burner has an enlarged surface area. By using the end cap as an active burner surface, more power can be generated for the same volume of the burner or using the invention in the reverse way, the same amount of power can be generated for a smaller volume of the burner, making gas burners more compact and yet providing optimal combustion. As such, they guarantee optimal combustion in the limited available space of modern heat exchangers by making optimal use of the space available in a heat exchanger.

Moreover, the gas burner of the present invention provides a gas flow in the gas supply chamber which is more uniform and has an improved flame distribution. The gas can flow freely through the gas burner from the gas inlet side further axially through the burner. Gasflow is not hindered at the end of the burner. Since the end cap performs an active burner role in the gas burner of the present invention, problems with fixation zones, e.g. welding zones, (e.g. cracks caused by temperature difference) between the first burner membrane and end cap are reduced considerably. Thus, problems with conventional gas burners having an impermeable end cap are solved as an immediate consequence thereof: there is no pressure build-up at the end cap, no noise effects or damage generated thereby, no flaring of flames, no overheating of the end cap, no cracks due to thermal expansion difference between burner side and end, and better gasflow and thus reduction of NOx and CO emission. This provides a more stable burner.

As the first burner membrane and the second burner membrane are two pieces, a different material can be used for both pieces. Said material can be adapted for example to a different heat-resistance.

In a further aspect, a gas burner is provided, wherein said first burner membrane and/or said end cap comprises a perforated heat-resistant sheet metal plate, preferably stainless steel, more preferably FeCralloy®, NiCralloy® or Aluchrome®.

In a first preferred embodiment the end cap is connected to the first burner membrane at the topside of the gas supply chamber through welding, for example spot, TIG or laser welding. In another preferred embodiment, the end cap is connected to the first burner membrane through folding. Preferably, there is no or limited overlap of material between the first burner membrane and the end cap.

In another aspect, the invention provides a gas burner wherein the first burner membrane and the end cap are connected seamlessly or quasi uninterruptedly, hereby avoiding as much as possible any hindering fixation points or sharp edges between the two surfaces. This improves a homogeneous gas flow.

In an alternative embodiment the engagement of the borders of the topside of the first burner membrane and the end cap are not fully closed. The connection region or seam comprises holes or non-attached zones, whereas the end cap is fixed firmly to the top of the burner. This provides an even more improved homogeneous flame distribution.

The invention further relates to a gas burner, wherein said first and second burner membranes can have many different shapes.

An aspect of the present invention provides a gas burner wherein the end cap is flat. In an alternative embodiment the end cap is convex, meaning that the curvature of the end cap surface extends outwards of the burner. The end cap can also be concave or a combination of convex and concave waves.

In an alternative embodiment, the end cap has the shape of a cone, a prism, a pyramid, a sphere or any other shape derived there from, for example a cone with a flattened top.

In a specific design of heat exchanger it may be advantageous to provide the end of the burner in a more complex geometric body, such as for example a tubular shaped burner with a cone shaped end cap.

In a preferred embodiment, the first burner membrane of the gas burner of the present invention has the shape of a cylinder, a cone, a prism, a pyramid, a sphere or any other shape derived there from, such as, for example, a cylinder with rounded edges.

In a specific embodiment the first burner membrane has a rounded edge at the side opposite to the gas inlet side, as to provide an opening wherein the end cap fits. The rounding of the edge provides a fluency in gas flow and prevents fixations in sharp edges. This also facilitates the design and manufacture of the end cap, which can be completely flat in a specific embodiment. An example of a cylindrical burner having said rounded edge and a flat end cap fitted into the opening formed by this edge is shown in the Figures.

In an alternative embodiment the end cap has rounded edges providing an opening wherein the side of the first burner membrane fits quasi seamlessly.

Preferably, the base section of the first burner membrane has the shape of a circle, an ellipse or oval, a square, a rectangle, a diamant, a triangle, a pentagon, a hexagon or any other shape derived there from, such as for example a hexagon with rounded corners.

In a preferred embodiment the invention provides a gas burner wherein the first burner membrane is cylindrical or tubular, and the end cap burner surface is convex or flat and parallel to the plane of the base section.

In a further aspect the invention provides a gas burner comprising a pressure divider or gas distributor to allow an optimal gas distribution to the burner membrane. Besides perforations on the side, perforations can also be present at the end cap of said inner structure in order to allow gas to flow to the end cap of the burner membrane. Preferably the inner structure is made in one piece, but for reasons of constructional difficulty e.g., the pressure divider can be produced of two separate pieces.

The shape and size (dimensions) of the gas burner of the present invention can easily be adapted to the dimensions of the combustion chamber of modern heat exchangers. The side of the burner and the end cap can each be designed for optimal space use and flame production, hereby having each an own shape and material used.

The person skilled in the art will understand that a large range of dimensions, both in shape, diameter and height of the gas burner may be obtained by the gas burner of the present invention, as well as a large number of combinations of material to be used for the side and the end cap burner membrane.

By way of example some embodiments of the invention are described by the accompanying figures and drawings.

BRIEF DESCRIPTION OF FIGURES IN THE DRAWINGS

Figure 1B:
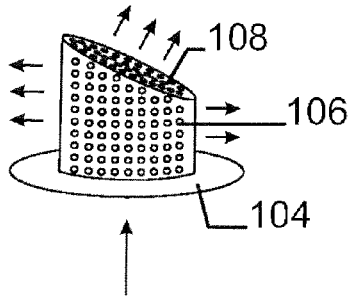
Figure 1C:
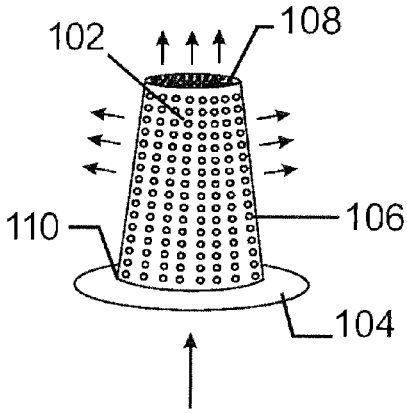

FIG. 1 is a schematic drawing of a burner according to the invention. FIGS. 1*a* and 1*b* show a cylindrical burner; FIG. 1*c* shows a conical burner.

Figure 2A:
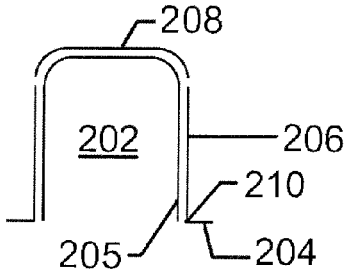
Figure 2B:
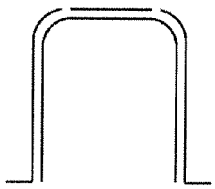
Figure 2C:
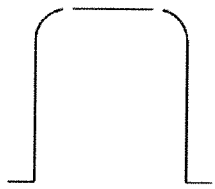
Figure 2D:
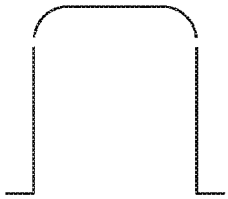

FIGS. 2*a* and 2*b* show a cross-section of a cylindrical burner with an active end cap. FIGS. 2*c* and 2*d* show alternative embodiments without innertube.

Figure 3A:
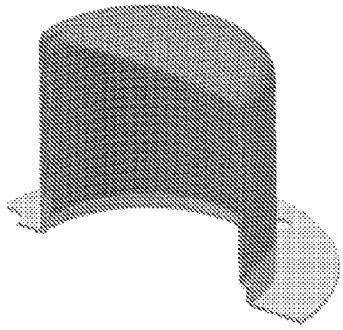
Figure 3B:
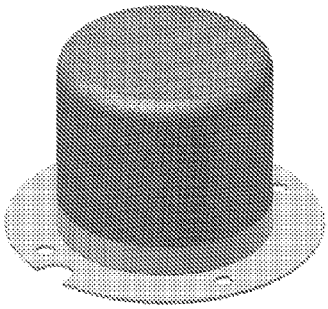

FIGS. 3*a* and 3*b* show a cross-section of a exemplary cylindrical burner comprising two, preferably stainless steel, structures: a perforated inner tube (pressure divider) and a perforated outer tube (burner surface).

Figure 4A:
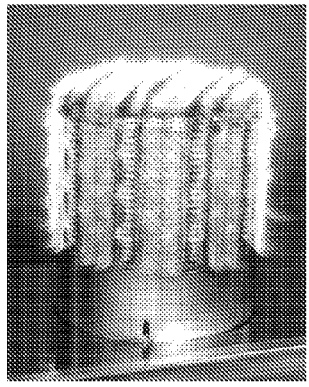
Figure 4B:
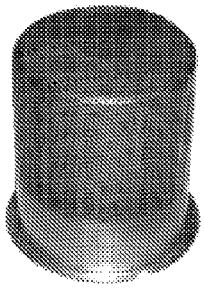

FIG. 4 shows a picture of an alternative tubular burner comprising burner membranes both in perforated stainless steel.

Figure 5A:
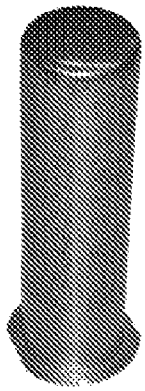
Figure 5B:
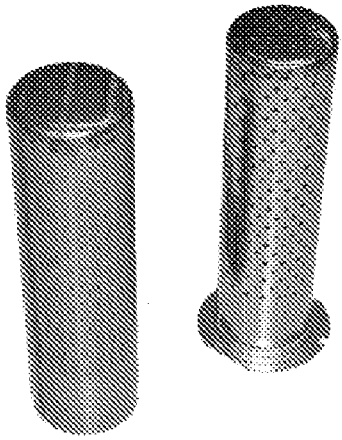

FIG. 5*a* shows a long and slim tubular burner membrane in perforated stainless steel, fitted over a perforated stainless steel innertube. FIG. 5*b* shows a demounted construction of FIG. 5*a*.

REFERENCE NUMBER LIST

102, 202 gas supply chamber
104, 204 support
205 perforated innertube, pressure divider
106, 206 first burner membrane
108, 208 second burner membrane
110, 210 base section of first burner membrane

MODE(S) FOR CARRYING OUT THE INVENTION

FIG. 1*a* shows a cylindrical burner according to the invention comprising a gas supply chamber 102 connected at the bottom to a support 104. The support 104 has a central gas inlet port for supply of gas into the gas supply chamber 102. The gas supply chamber 102 is enclosed by a first burner membrane 106 at its side and a second burner membrane 108 opposite to the gas inlet port. The second burner membrane 108 is connected to the top of the burner membrane 106. The burner membrane 106, is connected at the bottom to the support 104. The arrows represent the flames being produced in a direction substantially perpendicular to the burner surface, hereby providing a radial gasflow at the first burner membrane 106, and an axial gasflow at the second burner membrane 108.

FIG. 1*b* shows a similar cylindrical burner as the burner of FIG. 1*a*, whereby the second burner membrane 108 forms a plane at an angle different from 90 degrees intersecting the first burner membrane 106. The arrows again represent the flames being produced in a direction substantially perpendicular to the burner surfaces 106 and 108.

FIG. 1*c* shows an alternative conical shaped burner according to the invention, comprising a first burner membrane 106 connected at its base section 110 to a support 104. The support 104 has a central gas inlet port for supply of gas into the gas supply chamber 102. The second burner membrane 108 is parallel to the plane of the base section 110. The arrows represent the flames being produced in a direction substantially perpendicular to the burner surface, hereby providing a radial gasflow at the first burner membrane 106, and an axial gasflow at the second burner membrane 108.

FIGS. 2*a* and 2*b* show a cross-section of a cylindrical burner with active end cap 208 connected quasi seamlessly to the first burner membrane 206 at the side of the gas supply chamber 202. A perforated innertube 205 may optionally be provided in the gas supply chamber 202. In FIG. 2*a* the second burner membrane has rounded edges providing an opening wherein the end of the first burner membrane fits quasi seamlessly. The seam being formed on the side of the cylinder. FIG. 2*b* is an example of a cylindrical burner having rounded edge and a flat second burner membrane fitted into the opening formed by this edge. Here, the seam is formed on top of the burner. FIGS. 2*c* and 2*d* show alternative embodiments without innertube.

FIG. 3*a* shows a cross-section of a cylindrical burner comprising two, preferably stainless steel, structures: a perforated inner tube (pressure divider) and a perforated outer tube (burner surface). At the center of the support a gas inlet can be fitted to let gas into the gas supply chamber within the inner tube. The side opposite of the gas inlet side shows a perforated end cap, in the inner and the outer tube. As can be seen on the outer tube, the end cap and the first burner membrane are two parts connected to each other through a seam. The edges of the side of the outer membrane are rounded towards the end cap and provide an opening for the flat end cap to fit in.

FIG. 4 shows a picture of an alternative burner produced according to the invention. The tubular burner comprises a first burner membrane and an end cap both in perforated stainless steel. These can optionally be fitted over a perforated stainless steel innertube or pressure divider. In this exemplary embodiment, the end cap or second burner surface has a diameter of 70 mm. The L/D ratio is approximately 1. The end cap is slightly convex and has rounded edges towards the side of the burner. The side of the burner has straight edges. Both edges of the end cap and the side are connected through a TIG welded seam.

FIG. 5 is a burner made according to the invention. FIG. 5*a* shows a tubular burner comprising a side and an end cap both in perforated stainless steel, fitted over a perforated stainless steel innertube (pressure divider), as shown in the demounted construction of FIG. 5*b*. The tubular burner construction comprises (on the left) a perforated stainless steel burner membrane that fits over the perforated stainless steel innertube shown on the right. The outer tube is connected at the bottom to the innertube. The end cap is mounted the same way as mentioned in FIG. 4. In this exemplary embodiment, the end cap has a diameter of 63 mm. The burner is long and slim.

The applications of the burners according to the invention are very diverse in nature, such as for example residential and industrial premix burners, residential water heaters, industrial boilers and water heaters, infrared radiators for industrial operations and in the food industry.

The invention claimed is:

1. A gas burner, comprising:

a support having a central gas inlet port for supply of gas into a gas supply chamber, wherein said gas supply chamber is enclosed by a surface, wherein said surface comprises a first burner membrane and an end cap substantially opposite to said gas inlet port, wherein said end cap is connected to a top of said first burner membrane, wherein said first burner membrane is connected at a bottom to said support through a base section of the first burner membrane, wherein said end cap is formed by a second burner membrane, wherein an exterior surface of said first burner membrane and an exterior surface of said second burner membrane are perforated heat-resistant metal plates, and wherein the second burner membrane is connected with the first burner membrane through a seam, said seam having interruptions for providing a further burner surface.

2. A gas burner as in claim 1, wherein said metal plates are stainless steel plates.

3. A gas burner as in claim 1, wherein the second burner membrane is welded to the first burner membrane.

4. A gas burner as in claim 1, wherein said first burner membrane has a shape of a cylinder, a cone, a prism, a pyramid, or a sphere.

5. A gas burner as in claim 1, wherein the base section of the first burner membrane has a shape of a circle, an ellipse, a square, a rectangle, a diamond, a triangle, a pentagon, or a hexagon.

6. A gas burner as in claim 1, wherein said second burner membrane is flat, convex, concave, or a combination of convex and concave waves.

7. A gas burner as in claim 1, wherein said second burner membrane has a shape of a cone, a prism, a pyramid, or a sphere.

8. A gas burner as in claim 1, wherein said first and second burner membranes enclose a perforated stainless steel pressure divider, and wherein the pressure divider has a side, a top, and perforations at the side and the top of the pressure divider.

9. A gas burner as in claim 1, wherein the gas burner is a premix burner.

10. A gas burner as in claim 1, wherein the exterior surfaces of the first and second burner membranes form an exterior surface of the burner configured such that combustion occurs at the exterior surfaces of the first and second burner membranes.

11. A gas burner as in claim 1, wherein the seam comprises holes or non-attached zones.

12. A gas burner as in claim 1, wherein the support is an annular disc having an outer diameter that is larger than a perimeter of the end cap, and an end face that is arranged perpendicular to the first burner membrane.

13. A gas burner, comprising:

a gas supply chamber bordered by a first burner membrane and an end cap; and a support having a gas inlet port placed on a central axis of the burner for supply of gas into the gas supply chamber, wherein the end cap is substantially opposite to the gas inlet port, is fixed directly onto a top of the first burner membrane, and is formed by a second burner membrane, wherein the first burner membrane comprises a base section, and is connected at a bottom to the support through the base section, wherein exterior surfaces of the first burner membrane and the second burner membrane are perforated heat-resistant metal plates, and wherein the second burner membrane is connected with the first burner membrane through a seam, said seam having interruptions for providing a further burner surface.

14. A gas burner as in claim 13, wherein the metal plates are stainless steel plates.

15. A gas burner as in claim 13, wherein the base section of the first burner membrane has a shape of one of a circle, an ellipse, a square, a rectangle, a diamond, a triangle, a pentagon, and a hexagon.

16. A gas burner as in claim 13, wherein the second burner membrane is one of flat, convex, concave, and a combination of convex and concave waves.

17. A gas burner as in claim 13, wherein the second burner membrane has a shape of one of a cone, a prism, a pyramid, and a sphere.

18. A gas burner as in claim 13, wherein the first burner membrane and the second burner membrane enclose a perforated stainless steel pressure divider, and wherein the pressure divider has a side, a top, and perforations at the side and the top of the pressure divider.

19. A gas burner as in claim 13, wherein the exterior surfaces of the first and second burner membranes form an exterior surface of the burner configured such that combustion occurs at the exterior surfaces of the first and second burner membranes.

20. A gas burner as in claim 13, wherein the seam comprises holes or non-attached zones.

* * * * *